United States Patent [19]

Ruf et al.

[11] 4,181,113

[45] Jan. 1, 1980

[54] ENGINE IGNITION SYSTEM WITH VOLTAGE MONITORING

[75] Inventors: Walter Ruf, Korntal-Münchingen; Heinz Krauss, Stuttgart, both of Fed. Rep. of Germany

[73] Assignee: Robert Bosch GmbH, Stuttgart, Fed. Rep. of Germany

[21] Appl. No.: 845,799

[22] Filed: Oct. 26, 1977

[30] Foreign Application Priority Data

Oct. 27, 1976 [DE] Fed. Rep. of Germany ..... 2648517

[51] Int. Cl.[2] ..... F02P 9/00

[52] U.S. Cl. ..... 123/148 E; 315/209 R

[58] Field of Search ..... 123/148 E, 148 D, 148 DC, 123/148 S; 315/209 R, 209 T

[56] References Cited

U.S. PATENT DOCUMENTS

| | | | |
|---|---|---|---|
| 3,882,840 | 5/1975 | Adamain et al. | 123/148 E |
| 3,941,112 | 3/1976 | Habert | 123/148 DC |
| 3,949,722 | 4/1976 | Linstedt et al. | 123/148 E |
| 4,036,199 | 7/1977 | Chateau | 123/148 E |
| 4,074,665 | 2/1978 | Patis | 123/148 E |
| 4,084,567 | 4/1978 | Hachiga | 123/148 E |

*Primary Examiner*—Gerald Brigance

*Attorney, Agent, or Firm*—Frishauf, Holtz, Goodman & Woodward

[57] ABSTRACT

A voltage divider across the interruptor switch contacts provides a measure of the high voltage produced before a spark occurs at the sparkplug. A Zener diode connected to the upper tap of the voltage divider breaks down when this voltage has risen a certain amount as the result of wear of the sparkplug electrodes that widen the gap. The Zener voltage breakdown causes a relay to lock in and to short-circuit a current-limiting resistor in the spark coil primary circuit that allows a higher voltage spark to be produced to assure proper firing of the sparkplugs with the wider gap. Another Zener diode is connected to the lower tap of the voltage divider to sound an alarm and to disable the ignition circuit when the high voltage at which sparks strike in the sparkplug rises to a value for which the insulation of the spark coil and its connection is not designed to withstand.

12 Claims, 1 Drawing Figure

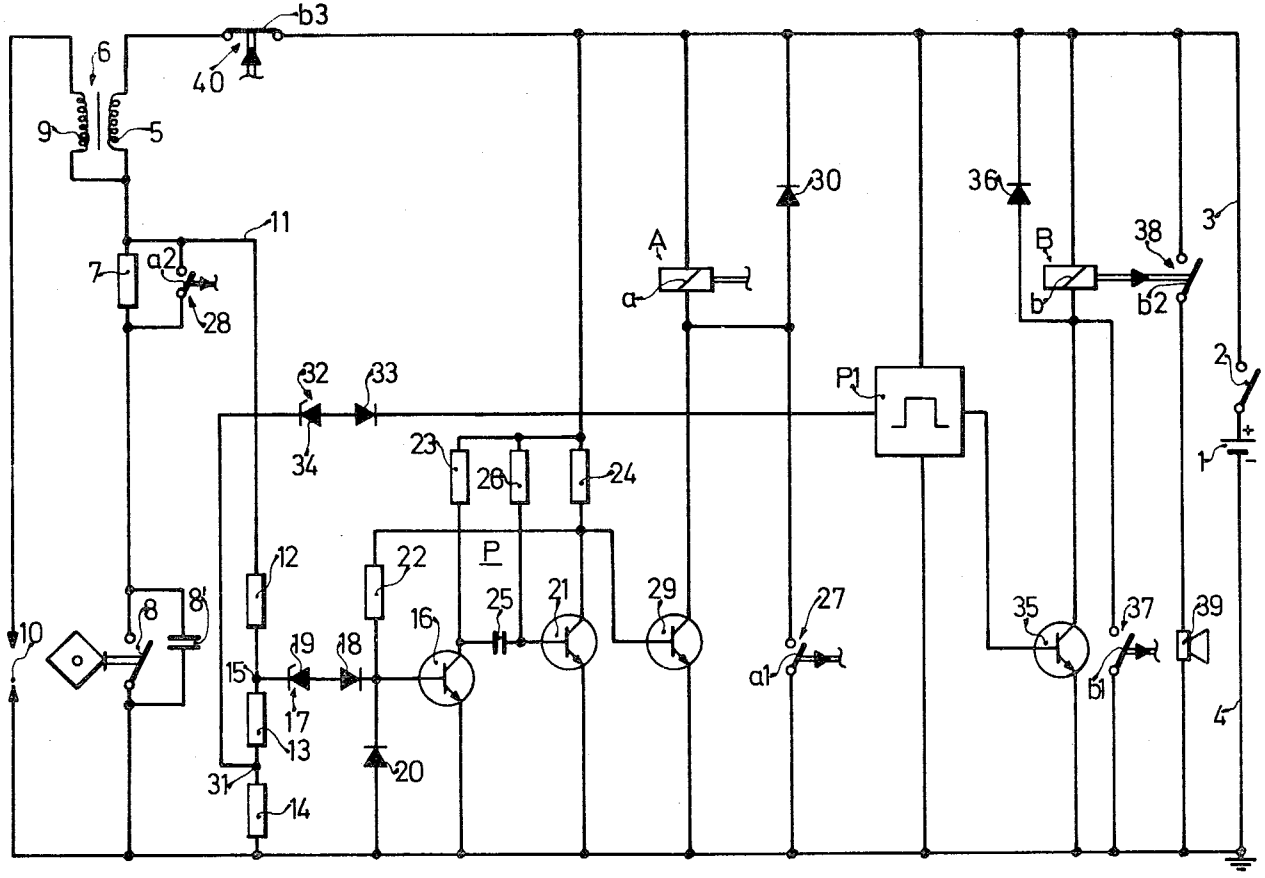
1
2
3
4
5
6
7
8
8'
9
10
11
12
13
14
15
16
17
18
19
20
21
22
23
24
25
26
27
28
29
30
31
32
33
34
35
36
37
38
39
40
A
B
P
P1
a
a1
a2
b
b1
b2
b3

ENGINE IGNITION SYSTEM WITH VOLTAGE MONITORING

This invention concerns an electrical ignition system for an internal combustion engine incorporating provisions for dealing with the widening of the sparkplug gap that gradually occurs with prolonged use of the engine.

The conventional ignition system includes an ignition transformer (sparkcoil) having a primary and a secondary winding with provision for causing sudden changes in the current in the primary winding so as to produce high-voltage pulses in the secondary winding which will then be applied to the spark gap of a sparkplug. A typically known ignition circuit is shown on page 323 of the 15th edition of the Bosch Motor Vehicle Handbook published in 1961, with the German title "BOSCH-Kraftfahrzeugtechnisches Taschenbuch," published at Düsseldorf by VDI-Verlag GmbH. In this and many other known circuits, if the electrode spacing in the sparkplug increases beyond a particular gap width as the result of the electrode tips being burned down in the course of use, disturbance in the operation of the ignition system can result and even damage as the result of undesired spark discharges in the system. Likewise, if the connection between the sparkplug and the secondary winding is interrupted, the buildup of high voltage and the occurrence of spark discharges in the system can likewise cause damage.

THE PRESENT INVENTION

It is an object of the present invention to provide an electrical ignition system for a gasoline engine in which damage or disturbance producing malfunction in the system resulting from the failure of a spark gap of the proper size to be connected when an ignition voltage pulse is produced can be avoided.

Briefly, a voltage appearing at a terminal of the primary winding of the ignition transformer is supplied to a monitoring circuit containing at least one monitoring component that has a substantially fixed breakdown voltage, preferably a Zener diode, connected in such a way as to control the operation of an electrically controllable switch which in turn produces a modification of the operating condition of the ignition system and/or a warning.

Preferably, the monitoring circuit has two Zener diodes connected so as to breakdown at different voltages appearing at the primary winding of the ignition transformer, each Zener diode controlling a different electrically controllable switch. The Zener diode that breaks down first is designed to respond to a widening of the sparkplug gap as the result of wear, and the switch which it controls accordingly short-circuits a current-limiting resistance in the circuit of the primary winding, so that a more powerful spark will be produced. The other Zener diode is designed to respond to conditions that cannot safely be corrected by increasing the spark power, and the switch it controls accordingly operates to disable the primary circuit of the ignition transformer and to set off an audible alarm.

The electrically controllable switches are arranged to hold themselves on, once a voltage breakdown in the particular branch of the monitoring circuit has occurred, and to be released when the supply voltage of the ignition circuit is next turned off. The switches are preferably relays with the appropriate operating and holding contacts. Between the monitoring Zener diode and the relay coil, there is preferably provided a pulse-forming circuit, such as a monostable multivibrator, that will provide a substantially rectangular pulse to the relay coil in response to the flow of current from the broken down Zener diode through the base-emitter circuit of an input transistor of the pulse-forming circuit.

The invention thus offers the advantage of both adjusting the ignition pulse energy to the spark gap of the sparkplug automatically and also providing a safety shutoff of the spark circuit when one of the sparkplugs of the engine is left disconnected or a connecting wire breaks.

Drawing, illustrating an example

The single FIGURE of the drawing is a circuit diagram of an embodiment of the invention providing all the advantages discussed above.

This circuit diagram represents the ignition system for an engine, not shown in the drawing which is the motor of a vehicle likewise not shown. The ignition system is supplied by a dc source 1, in this case the battery of the motor vehicle. A connection goes from the positive terminal of the current source 1 to the ignition switch 2 and thence to the positive supply line that is in effect the positive terminal for the various parts of the equipment supplied through the switch 2. The negative terminal of the battery has a connection 4 to chassis ground to which the negative supply line or lines for the equipment are connected. From the positive supply line 3, a circuit branch proceeds through the primary winding 5 of an ignition transformer (sparkcoil) 6, thence through a current-limiting resistor 7 and finally through the contacts of an interruptor switch 8, around which a disturbance-filter capacitor 8' is connected, to the chassis ground line 4.

The secondary winding 9 of the ignition transformer 6 has one side connected to the chassis ground line 4 and the other connected to a sparkplug 10. The end of the primary winding 5 that is remote from the positive supply line 3 is the branching point for a monitoring circuit 11 that leads through a first voltage divider resistor 12, then through a second voltage divider resistor 13 and finally through a third voltage divider resistor 14 to the chassis ground connection 4. This voltage divider resistor chain provides a first tap connection 15 from which a further branch circuit extends that goes to chassis ground through the base-emitter path of a first control transistor 16. This last-mentioned branch of the circuit proceeds from the tap connection 15 of the voltage divider through an electrical monitoring component 17 having a substantially fixed breakdown voltage and then through a diode 18 that is put into its conducting condition as the result of current through the primary winding 5 and finally through the base-emitter path of the first control transistor 16 to chassis ground connection 4. The monitoring component 17 is in the preferred case a Zener diode 19. In order to protect the base-emitter path of the first control transistor 16 against overvoltages in the blocking direction, a diode 20 is connected parallel to it having its cathode connected to the transistor base. The first control transistor 16 is a component of a pulse generator or pulse-shaping circuit P, in the illustrated case a monostable multivibrator that also contains a second control transistor 21. The first control transistor 16 has its emitter connected to chassis ground, its base to the cathode of the diode 18 and its collector to a resistor 23 that leads to the positive supply line connection 3. There is also a feedback resistor 22 connected between the base of the first control transistor 16 and the collector of the second control transistor 21. The latter transistor has its emitter connected to the chassis ground connection 4, its collector to a resistor 24 that leads to the positive supply connection 3 and its base connected both to a capacitor 25 and to a resistor 26 that leads to the positive supply line connection 3. The other terminal of the capacitor 25 is connected to the collector of the first control transistor 16. The output of the pulse generating circuit P is provided at the collector of the second control transistor 21 and produces rectangular pulses for controlling the electrically controllable switches 27 and 28 which, in the illustrated case, are sets of normally opened contacts, respectively a1 and a2 of the relay A. The winding a of the relay A is connected in a circuit branch that runs from the positive supply connection 3 to the collector of a transistor 29 and through the collector-emitter path of that transistor to chassis ground 4. The base electrode of the transistor 29 is connected with the collector of the second control transistor 21, thus with the output of the pulse generating circuit P. A kickback-preventing diode 30 is connected in parallel with the winding a of the relay A. The switch 27 is connected in shunt to the emitter-collector path of the transistor 29, whereas the switch 28 is connected in shunt to the current-limiting resistor 7.

The previously mentioned voltage divider resistor chain has a second tap 31 between the second voltage divider resistor 13 and the third voltage divider resistor 14. From the tap 31, another branch of the monitoring circuit 11 leads over to a second monitoring component 32 having a fixed breakdown voltage, and through that component to the anode of a diode 33, through the diode and from its cathode to the input of a second pulse generating circuit P1, which is constituted in exactly the same way as the pulse generating circuit P and, for that reason, is not illustrated in detail. The monitoring component 32 is in the preferred case again a Zener diode 34. The voltage values in the circuit at which the monitoring components 17 and 32 respectively break down are, however, selected to be different. In the illustrated case, the difference in the breakdown conditions is obtained by having the monitoring components 17 and 32 have the same voltage breakdown value, but connecting them to different potential steps of the voltage divider 12,13,14.

The pulse generator P1 has its output connected to the base of a transistor 35, of which the emitter is connected to chassis ground and the collector provides the beginning of a circuit branch that leads through the winding b of a relay B to the positive supply line 3. Again, a kickback diode 36 is connected in shunt to the coil d of the relay B. A normally open electrically controllable switch 37 is formed by the contact set b1 operable by the relay B, and this switch is connected in shunt to the emitter-collector path of the transistor 35. A likewise normally open electrically controllable switch 38 is provided by the contact set b2 of the relay B and is connected so as to operate an electric horn 39. A normally closed electrically controllable switch 40 is provided by the contact set b3 of the relay B that is interposed in the positive supply line 3 in such a way as to switch off only the current flowing through the primary winding 5 when the relay B is operated.

The circuit connected as described above operates as follows:

As soon as the ignition switch 2 is closed, the ignition system is ready for operation. When the interruptor switch 8 is closed, as it is for a major part of the time during operation, the primary winding 5 carries current supplied by the battery 1 and energy is thereby stored in the ignition transformer 6 for the forthcoming ignition event. At the moment of ignition timing, the interruptor switch 8 is opened by the well-known operation of an engine-driven cam, interrupting the flow of current in the primary winding 5 and thereby inducing a high-voltage pulse in the secondary winding 9, which produces an electric breakdown (ignition spark) in the sparkplug 10. After long periods of operation, the electrode spacing in the sparkplug 10 will be widened as the result of erosion by repeated firing. As this electrode spacing increases, the voltage value at which the electric discharge in the sparkplug 10 begins is also increased. In consequence, the high-voltage pulse at the secondary winding 9 and likewise also the value of induction voltage across the primary winding 5 also build up. An unlimited increase of these voltages is now prevented because the voltage between the tap 15 and chassis ground 4 finally produces a breakdown in the monitoring component 19, as the result of which current flows through the base-emitter path of the first control transistor 16 and puts the emitter-collector path of that transistor into the conducting condition. In consequence, the emitter-collector path of the second control transistor 21 is put into the non-conducting condition and the emitter-collector path of the transistor 29 in the conducting condition. As a result, the winding a of the relay A receives current and the switches 27 and 28 formed by the contacts a1 and a2 are closed. The switch 27 formed by the contacts a1 causes the relay A to continue to be energized and to hold the switch 27 and also the switch 28 closed. This condition is maintained after the rectangular pulse provided by the pulse generator P has died away, i.e. after the respective emitter-collector paths of the first control transistor 16 and the transistor 29 are again non-conducting and the emitter-collector path of the second control transistor 21 is again conducting. The closing of the switch 28 formed by the contacts a2 of the relay A produces a short-circuiting of the current-limiting resistor 7.

For a particular closed contact duration of the interruptor switch 8, the current in the parimary winding 5 will reach a higher value when the current-limiting switch 7 is short-circuited, so that the energy stored in the ignition transformer 6 will likewise rise to a higher total, so that the high-voltage pulse made available by the secondary winding 9 can be certain to produce an electric breakdown in the sparkplug 10, even after a further increase in the electrode spacing.

Of course, the voltages at the primary winding 5 and at the secondary winding 9 cannot increase indefinitely, because it is not practical to provide the necessary insulation to prevent undesired spark discharges and breakdown in the ignition transformer 6 and in the cable leading from the secondary winding 9 to the sparkplug 10. It is therefore provided that at a certain voltage value the monitoring component 32 will break down. The pulse generator circuit P1 is then triggered and its output rectangular pulse puts the emitter-collector path of the transistor 35 into its conducting condition and thereby produces a flow of current through the winding d of the relay B. Then the relay contacts b1 constituting the switch 37 are closed causing the relay B to be maintained in operated condition by supplying its coil with current after the rectangular pulse of the pulse generator circuit P1 has died away. The contacts b2 constituting the switch 38 likewise close causing the signal horn 39 to sound, so that it becomes easily recognizable that the sparkplug 10 is in bad condition without requiring a complicated search to identify the trouble. The normally closed contacts b3 constituting the switch 40 are now opened, to prevent continued operation of the ignition system with the dangers of such a poor condition of the sparkplug 10 and, at the same time, to require that the used-up sparkplug be replaced by a new one.

In the illustrated example, the monitoring components 17 and 32 have the same breakdown values, but are connected to taps 15 and 31 at different potential stages of the voltage divider 12,13 and 14. It is of course also possible to utilize monitoring components that have different breakdown values, so that they can be connected to a common tap of the voltage divider. Furthermore, the tap of the voltage divider can also be the slider of a variable resistor or potentiometer, by which a precise adjustment can be provided and if convenient, also, such readjustment or trimming as may be necessary or desirable.

Furthermore, in the illustrated example, a monostable multivibrator was selected for each of the pulse generating circuits P and P1. Instead of a monostable multivibrator, however, it is also possible to use a threshold switch operating after the fashion of a Schmitt trigger circuit.

Of course, the base-emitter path of transistor 21, transistor 29 and transistor 35 and the base-emitter path of the transistors incorporated in the pulse generating circuit P1, can all be protected in the same way that the base-emitter path of the first control transistor 16 is protected by the diode 20.

The relays A and B should preferably be constituted as delay-operate relays, so that an occasional single failure of a spark to fire at the usual voltage will not cause the monitoring circuit to perform fully, since if there is a condition that requires the monitoring circuit to operate, another pulse of the pulse-forming circuit will soon follow.

In the foregoing description, it has been assumed for simplicity that only a single sparkplug is operated by the ignition system, but of course the features of the invention can be applied in exactly the same way to an ignition system including a number of sparkplugs that are fired in a fixed firing order through an ignition distributor that connects them in turn to the secondary winding 9 of the ignition transformer.

It will therefore be seen that considerable variations in detail is possible within the inventive concept.

We claim:

1. An electrical ignition system for an internal combustion engine comprising an ignition voltage transformer having primary and secondary windings, the secondary winding being connected in circuit with at least one spark plug and the primary winding being connected to means for periodically causing a sudden change in current flow through the primary winding so as to induce a spark igniting voltage in the secondary winding, said system also comprising the improvement which consists in that:

at least one monitoring circuit (11) is connected to said primary winding (5) containing at least one component having a substantially constant breakdown voltage (17,32) of such a value that said breakdown voltage is reached as soon as the electrode spacing of said sparkplug (10) connected in circuit with said secondary winding (9) has increased to a predetermined value, said monitoring circuit being so constituted as to operate an electrically controllable switch (28,38,40) when that breakdown voltage is exceeded at said component, said electrically controllable switch having a switching path interposed in a circuit for modifying the operation of the ignition system and/or for producing a warning signal.

2. An ignition system as defined in claim 1, in which said component (17,32) having a substantially fixed breakdown voltage is a Zener diode (19,34) to which a voltage is applied in the blocking direction by the flow of current through said primary winding (5) of said ignition transformer.

3. An ignition system as defined in claim 2, in which said monitoring circuit (11) includes the base-emitter path of a control transistor (16) connected so as to receive current when a breakdown occurs in said monitoring component (17).

4. An ignition system as defined in claim 1, in which said electrically controllable switch (28,38,40) is a circuit closing switch having a switching path that is normally open but is closed when operated.

5. An ignition system as defined in claim 4, in which said electrically controllable switch has a normally open switching path arranged to short-circuit, when closed, a current-limiting resistance (3) that is connected in series to said primary winding (5), and in which said electrically controllable switch also has means for holding said switch in its operated position once it has reached that position, until the ignition system is turned off.

6. An ignition system as defined in claim 4, in which said electrically controllable switch (28,38,40) has a normally open switching path connected in circuit for switching on a warning signal generator (39) and also has means for holding said switch in operated position once it has reached that position, until the ignition system is turned off.

7. An ignition system as defined in claim 4, in which said electrically controllable switch is a relay having, in addition to a set of normally opened contacts providing said normal open switching path, a set of holding contacts, said relay being connected in circuit so that it is operated in response to a voltage breakdown of said monitoring component (17,32) and is released by interruption of the supply voltage of the ignition system.

8. An ignition system as defined in claim 1, in which said electrically controllable switch (28,38,40) is a circuit opener, having a normally closed switching path that is opened in the operated condition of the switch.

9. An ignition system as defined in claim 8, in which said electrically controllable switch (40) has a normally closed switching path in circuit with said winding in the operated condition of said switch, said switch also having means for holding itself in operated condition once that condition is reached, until thereafter the ignition system is turned off.

10. An ignition system as defined in claim 9, in which said electrically controllable switch is a relay having, in addition to said set of normally closed contacts constituting said normally closed switching path, also a set of holding contacts, said relay being connected in circuit so as to be operated in response to a breakdown of said monitoring component (17,32) and to be released by switching-off of the supply voltage of said ignition system.

11. An electrical ignition system for an internal combustion engine comprising an ignition voltage transformer having primary and secondary windings, the secondary winding being connected in circuit with at least one sparkplug and the primary winding being connected to means for periodically causing a sudden change in current flow through the primary winding so as to induce a spark igniting voltage in the secondary winding, said system also comprising the improvement which consists in that:

at least one monitoring circuit (11) is connected to said primary winding (5) containing a Zener diode (19,34) to which a voltage is applied in the blocking direction by the flow of current through said primary winding (5) and including the base-emitter path of a control transistor (16) connected so as to receive current when a breakdown occurs in said Zener diode (19,34), said control transistor (16) in said monitoring circuit (11) being a component of a pulse-forming circuit (P,P1) constituted so as to provide output pulses for control of an electrically controllable switch (28,38,40) that are at least approximately rectangular control pulses for operating said electrically controllable switch (28,38,40) when the breakdown voltage of said Zener diode is exceeded, said electrically controllable switch having a switching path interposed in a circuit for modifying the operation of the ignition system and/or for producing a warning signal.

12. An electrical ignition system for an internal combustion engine comprising an ignition voltage transformer having primary and secondary windings, the secondary winding being connected in circuit with at least one sparkplug and the primary winding being connected to means for periodicially causing a sudden change in current flow through the primary winding so as to induce a spark igniting voltage in the secondary winding, said system also comprising the improvement which consists in that:

at least one monitoring circuit (11) is connected to said primary winding (5) containing at least one component having a substantially constant breakdown voltage (17,32) and so constituted as to operate an electrically controllable switch (28,38,40) when that breakdown voltage is exceeded at said component, said electrically controllable switch having contacts interposed in a circuit for modifying the operation of the ignition system and/or for producing a warning signal, and said monitoring circuit (11) has a plurality of branches each containing one of said monitoring components (17,32), the connection of said branches and of said monitoring components being such as to produce breakdown of the respective monitoring components at different voltage values appearing at the connection of said monitoring circuit with said primary winding (5) and corresponding to progressively wider spacing of the gap of said sparkplug, said branches of said monitoring circuit being respectively connected to different electrically controllable switches (28,38,40) for producing operation of said respective switches in response to the breakdown of the respective monitoring components (17,32).

* * * * *